US006878024B1

(12) United States Patent
Kohuth

(10) Patent No.: US 6,878,024 B1
(45) Date of Patent: Apr. 12, 2005

(54) HYDROSTATIC RELEASE MECHANISM

(75) Inventor: Kerry R. Kohuth, Waddell, AZ (US)

(73) Assignee: General Pneumatics Corporation, Orange, NJ (US)

( * ) Notice: Subject to any disclaimer, the term of this patent is extended or adjusted under 35 U.S.C. 154(b) by 20 days.

(21) Appl. No.: 10/693,282

(22) Filed: Oct. 24, 2003

(51) Int. Cl.[7] ..... B63C 9/22; B63B 22/14
(52) U.S. Cl. ..... 441/10; 114/367; 114/221 A
(58) Field of Search ..... 441/6–10, 23, 441/25, 32, 33; 114/221 A, 367; 89/1.13, 89/1.14; 83/639.1, 639.3, 639.4; 102/406, 102/411, 414; 43/17.2; 166/54.5

(56) References Cited

U.S. PATENT DOCUMENTS 2,926,565 A * 3/1960 Thorness ..... 89/1.14
3,885,484 A 5/1975 Sturgis
4,079,364 A 3/1978 Antenore
4,124,911 A 11/1978 Wildhagen
4,690,091 A * 9/1987 Persbeck ..... 114/221 A
4,903,382 A * 2/1990 Held et al. ..... 24/602
5,177,317 A * 1/1993 Walker et al. ..... 89/1.14
5,348,502 A 9/1994 Wigram
5,365,873 A 11/1994 Wigram
5,438,949 A * 8/1995 Day ..... 114/367
5,573,343 A 11/1996 Davis et al.
6,224,442 B1 5/2001 Simpson et al.
6,386,086 B1 * 5/2002 Garcia et al. ..... 89/1.13

FOREIGN PATENT DOCUMENTS

BE 563098 * 6/1958
JP 04050094 A * 2/1992

* cited by examiner

*Primary Examiner*—S. Joseph Morano
*Assistant Examiner*—Ajay Vasudeva
(74) *Attorney, Agent, or Firm*—Frank J. McGue

(57) ABSTRACT

A hydrostatic release mechanism is provided which comprises a sealed housing having an interior volume and a tunnel adapted to receive a tether extending therethrough. A depth sensor is mounted to the sealed housing and has a diaphragm covering an opening between the interior volume and the ambient conditions. A trigger is contained within the sealed housing and is operably connected to the diaphragm and a firing mechanism. The firing mechanism is actuated by movement of the trigger in response to inward movement of the diaphragm when the pressure on the diaphragm exceeds a predetermined force. The firing mechanism includes a piston having a blade which moves in response to the expanding gases from a pyrotechnic cartridge and passes through the tunnel thereby severing the tether extending therethrough.

14 Claims, 2 Drawing Sheets

HYDROSTATIC RELEASE MECHANISM

TECHNICAL FIELD

This invention relates generally to the field of hydrostatic release mechanisms, and, more particularly, to hydrostatic release mechanism which is designed to sever a tether securing a floating device from a watercraft when the watercraft is submerged to a predetermined depth.

BACKGROUND OF THE INVENTION

Floating devices such as emergency radio beacons or life rafts are normally secured to a watercraft by tethers when not in use. As is well known, such life rafts are designed for use by the crew of said watercraft in an emergency. However, when the crew finds itself in a rapid sinking situation caused by, for example, when the structural integrity of the watercraft is seriously compromised via a collision with another vessel or a reef, there may not be enough time to release all of the floating emergency equipment on a vessel. Other rapid sinking scenarios include, but are not limited to, explosions, fire, storms and the like. In such situations, the crew may find itself in the water with needed life rafts and emergency radio beacons still attached to the now submerged vessel.

There have been a number of mechanisms designed to alleviate this problem. For example, U.S. Pat. No. 6,224,442 entitled "Release Unit" issued on May 1, 2001 to Simpson et al. discloses a device for releasing a link between a first object and a second object. The device comprises a body having a holding means for securing the body to the link; a releasing means for releasing the link; a pyrotechnic composition for actuating the releasing means; an igniting means for igniting the pyrotechnic composition, the igniting means being actuated by an increase in ambient pressure; and a pressure sensing means for detecting a change in ambient pressure. In one embodiment, the device can include a sliding blade actuatable by a pyrotechnic composition that is ignited by an electrical stimulus activated by an increase in ambient pressure, and the link may be, for example, a cable securing an emergency radio beacon to a water craft. If the water craft becomes submerged, and the device is thereby exposed to an increase in ambient pressure, the electrical stimulus will be activated to ignite the pyrotechnic composition which, in turn, will actuate the sliding blade which then operates to cut the securing cable and release the EPIRB from the water craft. However, note the use of electrical stimulus to initiate the process.

U.S. Pat. No. 5,365,873 entitled "Hydrostatic Pressure Sensors" which issued on Nov. 22, 1994 to Wigram shows a hydrostatic pressure release for releasing a lift raft or the like when a ship sinks. A flexible diaphragm seals a chamber on one side and is exposed externally on its opposite side. A ceramic vent plug is mounted on the diaphragm so that it is protected within the casing of the device. The diaphragm has a resilient plate with an integral sleeve that projects through the collar in a rigid disc mounted on the plate. The plug is retained within the sleeve, in the collar. A rod projecting from the diaphragm extends into one end of an aperture in a slider and locks it in position. When the device is submerged, the diaphragm is deflected and pulls the rod out of the aperture allowing the slider to be released. A button on the slider extends into the other end of the aperture so that when it is depressed it pushes the rod out of the aperture and releases the slider.

U.S. Pat. No. 5,177,317 entitled "Cable Cutter Assembly" which issued on Jan. 5, 1993 to Walker et al. shows an explosive-type cable cutter assembly which includes a breech housing having a central passageway formed in it and a first slot extending from the exterior surface of the breech housing and opening into the passageway and a second slot extending from the exterior surface of the breech housing and opening into the passageway. The slots are each elongated in the direction of the central axis of the breech and each include a forward most edge and a rearward most edge. The cable cutting assembly also includes a threadable plug with an impact wall positioned forward of the slots and radial ports extending from the exterior surface of the breech housing into the passageway between the impact wall and the slots.

U.S. Pat. No. 3,885,484 entitled "Explosively Actuated Compressed Disc Line Cutter" which issued on May 27, 1975 to Sturgis provides a cutting tool for use in severing lines and cables, especially those which are constructed from multi-filament, low denier polymer resins. As explosively activated piston drives a compressed disc through a segment of a multi-filament cable or line, thereby shearing a small segment thereof.

None of the known prior art disclose the combination set forth herein.

SUMMARY OF THE INVENTION

It is an object of this invention to provide a hydrostatic release mechanism for releasing emergency equipment from a sinking vessel.

It is an further object of this invention to provide a release mechanism for emergency equipment which operates in response to ambient pressure change.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
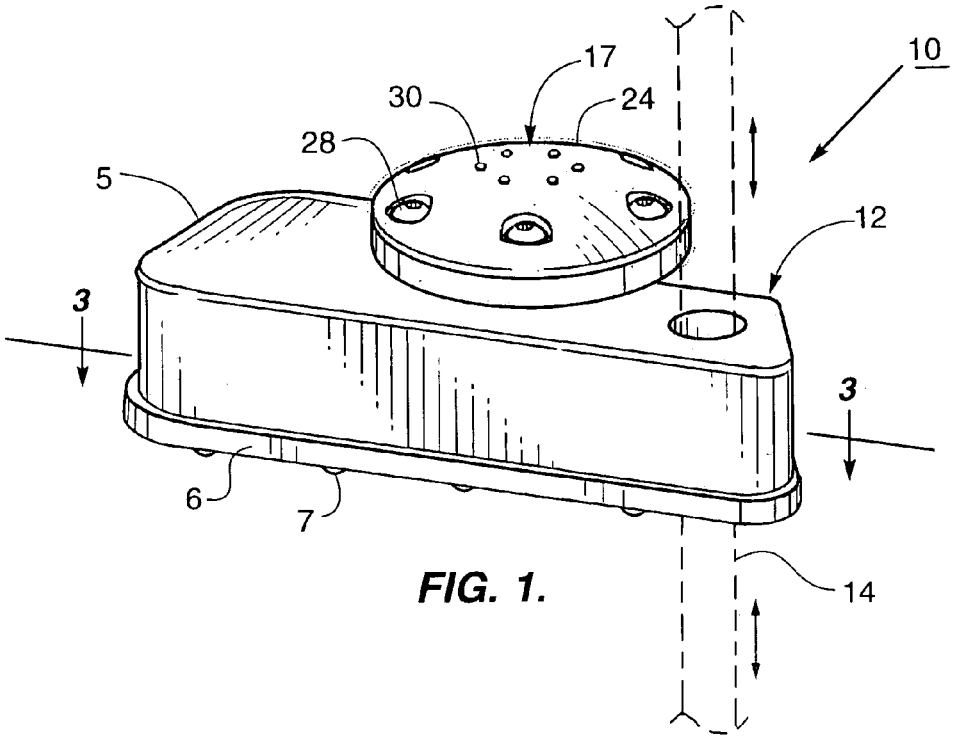
FIG. 1 is a perspective view of the present invention engaged with a tether.
Figure 3:
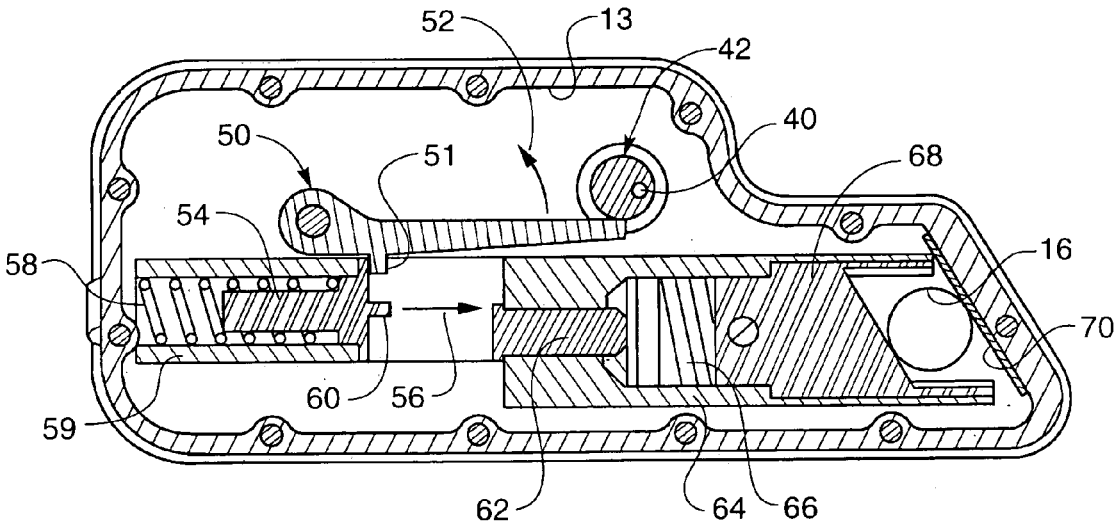
FIG. 3 is a top cross sectional view of the present invention.
Figure 2:
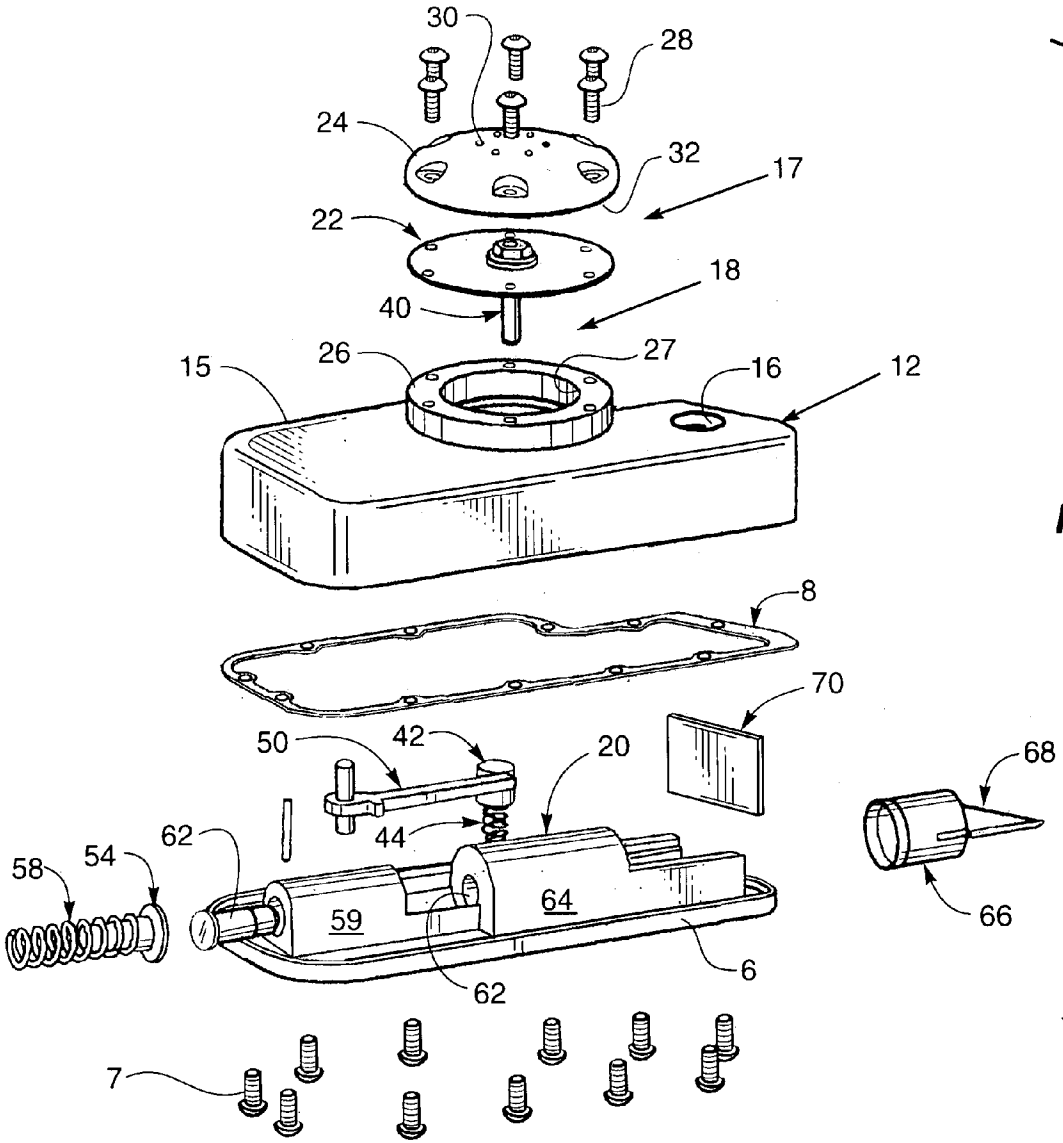
FIG. 2 is an exploded side view of the invention.

Referring more particularly to the drawings by characters of reference, FIGS. 1–3 disclose combinations of features which constitute the components of a hydrostatic release mechanism 10 of the present invention. Hydrostatic release mechanism 10 comprises a depth sensor 17 mounted to a sealed housing 12. In the illustrated embodiment, housing 12 comprises an upper portion 5 joined to a lower portion 6 by a plurality of bolts 7 thereby forming an interior volume 13. Those skilled in the art will recognize that other methods of joining are applicable to the present invention, including, but not limited to, ultrasonic welding.

A gasket 8 is captured between the peripheries of upper portion 5 and lower portion 6 to provide a seal between ambient conditions on the exterior of said housing and interior volume 13. Sealed housing 12 further provides a tunnel 16 extending through housing 12 which is adapted to receive a rope or tether 14 therein. Tunnel 16 is a continuous cylinder which is preferably integral with housing 12 but purposely thin and frangible by design. Housing 12 further includes a trigger 18 and a firing mechanism 20.

Those skilled in the art will recognize that while the present discussion relates to severing of rope or tether 14, the invention is applicable to use with other securing methods such as plastic cords or rods such as those used with emergency position indicating radio beacons (EPIRBs).

As shown, depth sensor 17 comprises a diaphragm 22 captured between a diaphragm cover 24 and a diaphragm frame 26. Diaphragm frame 26 defines an opening 27 between interior volume 13 and a small cavity 32 defined by diaphragm 22 and diaphragm cover 24.

In the presently preferred embodiment, diaphragm cover 24 and diaphragm 22 are secured to diaphragm frame 26 by six bolts 28 mounted to the periphery of frame 26, diaphragm 22 and diaphragm cover 24. Further, diaphragm cover 24 is provided with a plurality of passages 30 which provide liquid communication between the exterior of depth sensor 17 and small cavity 32.

When hydrostatic release mechanism 10 is submerged, water enters passages 30 and fills small cavity 32. As the depth increases, the hydrostatic pressure increases according to the well known formula (pressure=depth×water density).

The difference in pressure between the hydrostatic pressure from small cavity 32 on one side of diaphragm 22 to the sea level pressure contained on the other side of said diaphragm 22 maintained in interior volume 13 provides trigger mechanism 18 with means for actuating hydrostatic release mechanism 10. A trigger pin 40, a plunger 42 and a preloaded spring 44, in combination, hold diaphragm 22 in place until a predetermined trigger depth is reached. Preloaded spring 44 acts to prevent hydrostatic release mechanism 10 from accidentally triggering due to shock from drops and other rough handling. The trigger depth is predetermined by the characteristics of preloaded spring 44 wherein hydrostatic release mechanism 10 is actuated when the water pressure times the area of diaphragm 22 exceeds the outward force exerted by preloaded spring 44.

Firing mechanism 20 includes a latch 50 normally is restrained from rotational movement in the direction of arrow 52 by plunger 42. Latch 50, via a small protuberance 51, restrains a hammer 54 from linear movement in the direction of arrow 56. However, once plunger 42 is pushed downward a sufficient distance by trigger pin 40, latch 50 is no longer restrained (note the offset of trigger pin 40) and moves in the direction of arrow 52. Hammer 54 then moves in the direction of arrow 56 at the urging of a firing spring 58 contained within firing spring cylinder 59. A pointed feature 60 of hammer 54 contacts a pyrotechnic cartridge 62 mounted at one end of a barrel 64 causing it to fire.

The expanding gases from pyrotechnic cartridge 62 are contained within barrel 64. A piston 66 mounted opposite pyrotechnic cartridge 62 moves in response to those expanding gases. A blade 68 is mounted on piston 66 opposite the pyrotechnic cartridge 62. The force of the expanding gases is transferred to blade 68 via piston 66 and blade 68 is guided to pass perpendicularly through the thin walls of tunnel 16 thereby severing any tether 14 contained therein. The severing of tether or rope 14 releases the attached emergency device to float to the surface as needed.

For safety, a blade barrier 70 is preferably positioned along one side of tunnel 16 opposite blade 68 to prevent blade 68 from puncturing through housing 12.

Although only certain embodiments have been illustrated and described, it will be apparent to those skilled in the art that various changes and modifications may be made therein without departing from the spirit of the invention or from the scope of the appended claims.

What is claimed is:

1. A hydrostatic release mechanism for releasing an emergency device from a vessel, the hydrostatic release mechanism comprising:

a sealed housing having an interior volume, the sealed housing having a tunnel passing therethrough, said tunnel adapted to receive a tether extending therethrough, a depth sensor mounted to the sealed housing, the depth sensor having a diaphragm covering an opening between the interior volume and a diaphragm cover extending over the diaphragm opposite the interior of the sealed housing, the diaphragm cover having one or more passages therethrough which provide liquid communication between the exterior of the depth sensor and a small cavity defined by the diaphragm and the diaphragm cover, a trigger contained within the sealed housing, the trigger having a trigger pin, a plunger and a preloaded spring which are connected to the diaphragm, the preloaded spring resiliently urging said diaphragm outwardly from the interior volume with an outward force, a firing mechanism contained within the sealed housing, the firing mechanism being actuated by movement of the plunger in response to inward movement of the diaphragm when the pressure on the diaphragm exceeds the outward force, the firing mechanism having a hammer which is driven against a pyrotechnic cartridge, the pyrotechnic cartridge being mounted at one end of a barrel, the pyrotechnic cartridge firing and emitting expanding gases which are contained within the barrel, a piston mounted at the other end of the barrel, the piston moving in response to the expanding gases, the piston having a blade mounted thereon opposite the pyrotechnic cartridge whereby the force of the expanding gases is transferred to the blade via the piston, the blade being guided to pass perpendicularly through the tunnel to thereby sever the tether.

2. The hydrostatic release mechanism of claim 1 wherein the sealed housing comprises an upper portion joined to a lower portion by a plurality of bolts to form the interior volume.

3. The hydrostatic release mechanism of claim 2 further comprising a gasket captured between the peripheries of the upper portion and the lower portion.

4. The hydrostatic release mechanism of claim 1 wherein the sealed housing comprises an upper portion joined to a lower portion by ultrasonic welding to form the interior volume.

5. The hydrostatic release mechanism of claim 4 further comprising a gasket captured between the peripheries of the upper portion and the lower portion.

6. The hydrostatic release mechanism of claim 1 wherein the tunnel is a continuous cylinder which is integral with the sealed housing, the tunnel being thin and frangible.

7. The hydrostatic release mechanism of claim 1 further comprising a diaphragm frame defining the opening, the diaphragm cover and the diaphragm being secured to the diaphragm frame a plurality of bolts extending through the periphery of the diaphragm frame, the diaphragm and the diaphragm cover.

8. The hydrostatic release mechanism of claim 1 whereby the outward force is predetermined by electing a trigger depth whereby the water pressure at the trigger depth times the area of the diaphragm exceeds the upward force.

9. The hydrostatic release mechanism of claim 1 wherein the firing mechanism further comprises a latch which is restrained from rotational movement by the plunger when the outward force exceeds the pressure on the diaphragm, the latch restraining the hammer from movement until said plunger is moved a sufficient distance by the trigger pin when the outward force is less than the pressure on the diaphragm whereby the latch is no longer restrained, and moves under the urging of the hammer which is driven against the pyrotechnic cartridge at the urging of a firing spring.

10. The hydrostatic release mechanism of claim 1 further comprising a blade barrier positioned along one side of the tunnel opposite the blade to prevent said blade from puncturing through the housing.

11. A hydrostatic release mechanism for releasing an emergency device from a vessel, the hydrostatic release mechanism comprising:

a sealed housing comprises an upper portion joined to a lower portion to form an interior volume, a gasket captured between the peripheries of the upper portion and the lower portion, the sealed housing having a tunnel passing therethrough, said tunnel adapted to receive a tether extending therethrough, the tunnel being a continuous cylinder which is integral with the sealed housing, the tunnel being thin and frangible, a depth sensor mounted to the sealed housing, the depth sensor having a diaphragm covering an opening between the interior volume and a diaphragm cover extending over the diaphragm opposite the interior of the sealed housing, the diaphragm cover having one or more passages therethrough which provide liquid communication between the exterior of the depth sensor and a small cavity defined by the diaphragm and the diaphragm cover, a diaphragm frame defining the opening, the diaphragm cover and the diaphragm being secured to the diaphragm frame a plurality of bolts extending through the periphery of the diaphragm frame, the diaphragm and the diaphragm cover, a trigger contained within the sealed housing, the trigger having a trigger pin, a plunger and a preloaded spring which are connected to the diaphragm, the preloaded spring resiliently urging said diaphragm outwardly from the interior volume with an outward force, the outward force is predetermined by electing a trigger depth whereby the water pressure at the trigger depth times the area of the diaphragm exceeds the upward force, a firing mechanism contained within the sealed housing, the firing mechanism being actuated by movement of the plunger in response to inward movement of the diaphragm at the trigger depth when the pressure on the diaphragm exceeds the outward force, the firing mechanism having a hammer which is driven against a pyrotechnic cartridge, the pyrotechnic cartridge being mounted at one end of a barrel, the pyrotechnic cartridge firing and emitting expanding gases which are contained within the barrel, a piston mounted at the other end of the barrel, the piston moving in response to the expanding gases, the piston having a blade mounted thereon opposite the pyrotechnic cartridge whereby the force of the expanding gases is transferred to the blade via the piston, the blade being guided to pass perpendicularly through the tunnel thereby severing a tether extending therethrough, and a blade barrier positioned along one side of the tunnel opposite the blade to prevent said blade from puncturing through the housing.

12. The hydrostatic release mechanism of claim 11 wherein the firing mechanism further comprises a latch which is restrained from rotational movement by the plunger when the outward force exceeds the pressure on the diaphragm, the latch restraining the hammer from rotational movement until said plunger is moved a sufficient distance by the trigger pin when the outward force is less than the pressure on the diaphragm whereby the latch is no longer restrained and moves under the urging of the hammer which is driven against the pyrotechnic cartridge at the urging of a firing spring.

13. The hydrostatic release mechanism of claim 1 wherein the upper portion is joined to the lower portion by a plurality of bolts.

14. The hydrostatic release mechanism of claim 11 wherein the upper portion is joined to the lower portion by ultrasonic welding.

* * * * *